US006111363A

United States Patent [19]

Nerone

[11] Patent Number: 6,111,363

[45] Date of Patent: Aug. 29, 2000

[54] BALLAST SHUTDOWN CIRCUIT FOR A GAS DISCHARGE LAMP

[75] Inventor: Louis R. Nerone, Brecksville, Ohio

[73] Assignee: General Electric Company, Schenectady, N.Y.

[21] Appl. No.: 09/358,631

[22] Filed: Jul. 21, 1999

[51] Int. Cl.[7] ..... H05B 37/02

[52] U.S. Cl. ..... 315/225; 315/209 R; 315/244; 315/DIG. 4

[58] Field of Search ..... 315/225, 244, 315/209 R, DIG. 4, 291, 307, DIG. 7

[56] References Cited

U.S. PATENT DOCUMENTS

| | | | |
|---|---|---|---|
| 5,636,111 | 6/1997 | Griffin et al. | 363/37 |
| 5,729,096 | 3/1998 | Liu et al. | 315/225 |
| 5,770,925 | 6/1998 | Konopka et al. | 315/225 |
| 5,796,214 | 8/1998 | Nerone | 315/209 R |
| 5,869,935 | 2/1999 | Sodhi | 315/225 |
| 5,945,783 | 8/1999 | Schultz | 315/219 |
| 5,969,483 | 10/1999 | Li et al. | 315/225 |

*Primary Examiner*—Don Wong
*Assistant Examiner*—Tuyet T. Vo
*Attorney, Agent, or Firm*—Fay, Sharpe, Fagan, Minnich & McKee, LLP

[57] ABSTRACT

A ballast circuit 10 for a gas discharge lamp 14, incorporates a shutdown circuit 12 for limiting voltage output of a d.c.-to-a.c. converter 21. The shutdown circuit includes a pair of terminals 66 and 68 connecting across an inductor 48 in order to sense the inductive voltage of the d.c.-to-a.c. converter 21. A rectifier network 70–76 receives the inductor voltage and generates a full-wave rectified voltage. A latch 84 is arranged to receive the rectified voltage and to enter an active state when the rectified voltage is above a predetermined value. A time delay circuit 118 located between the rectifier network 70–76 and the latch 84 provides an adjustable delay time prior to activation of the latch network. Upon activation of the latch, the inductor voltage is decreased and the ballast circuit 10 is taken out of resonance thereby lowering the voltage and current applied to the resonant circuit 28.

20 Claims, 3 Drawing Sheets

BALLAST SHUTDOWN CIRCUIT FOR A GAS DISCHARGE LAMP

FIELD OF INVENTION

The present invention relates to a ballast, or power supply circuit, for gas discharge lamps of the type using regenerative gate drive circuitry to control a pair of serially connected, complementary conduction-type switches of a dc-ac converter. More particularly, the invention relates to a shutdown circuit which limits the output voltage of the ballast at times when the potential for high voltage exists, including but not limited to lamp removal and end-of-life effects.

BACKGROUND OF THE INVENTION

U.S. Pat. No. 5,796,214 filed on Sep. 6, 1996 by the present inventor, discloses ballast circuits using regenerative gate drive circuitry to control a pair of serially connected, complementary conduction-type switches of a dc-ac converter. Such switches may, for example, comprise an n-channel enhancement mode MOSFET and a p-channel enhancement mode MOSFET, for example. In the disclosed ballast, the phase angle between a resonant load current and a control voltage for the switches moves towards 0° during lamp ignition, providing reliable lamp ignition.

It would be desirable to adapt the foregoing ballast to limit the output voltage at times when the potential for a high voltage exists, such as when a lamp is removed, or when end-of-life effects create the potential for high voltage situations.

BRIEF SUMMARY OF THE INVENTION

In an embodiment of the present invention, a ballast shutdown circuit is provided to be operational when a high voltage situation exists at the circuit output for longer than a predetermined starting time. The shutdown circuit increases the frequency of the ballast above resonant frequency of the tuned circuit, thereby limiting the output voltage. A shutdown circuit senses voltage in excess of the predetermined voltage causing a latch circuit to be activated which lowers the voltage level being supplied to the circuit, which in turn increases the frequency so as to take the circuit out of resonance.

DETAILED DESCRIPTION OF THE INVENTION

Figure 1:
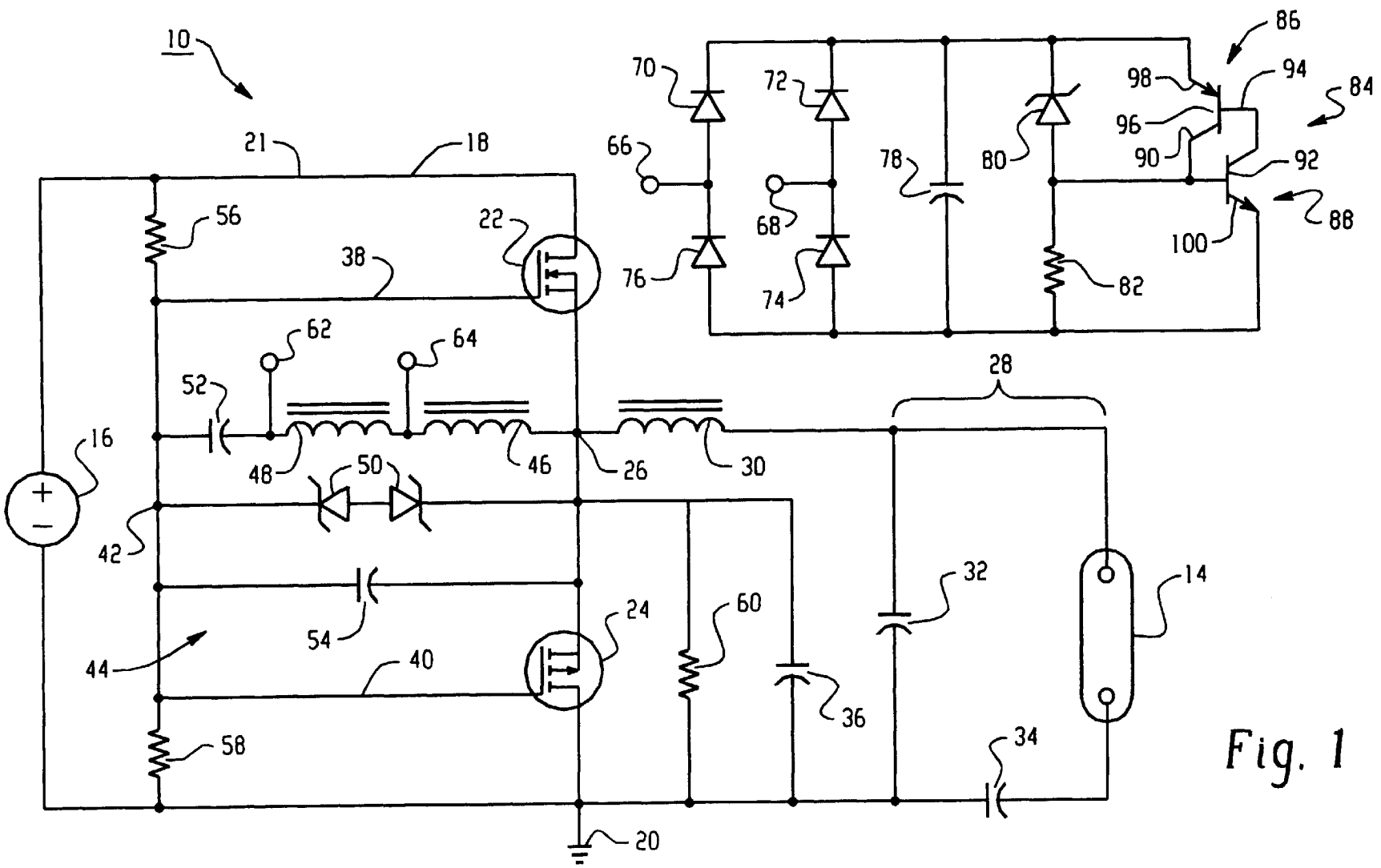
FIG. 1 is a schematic diagram of a ballast incorporating a shutdown circuit according to the teachings of an embodiment of the present invention.

FIG. 1 shows a ballast circuit 10 incorporating a shutdown circuit 12 in accordance with one embodiment of the present invention. A gas discharge lamp 14 is powered from a d.c. bus voltage generated by source 16. The d.c. bus voltage exists between a bus conductor 18 and a reference conductor 20, after such voltage is converted to a.c., by d.c.-to-a.c. converter 21.

Switches 22 and 24, serially connected between conductors 18 and 20, are used in the conversion process. When the switches comprise n-channel and p-channel enhancement mode MOSFETs, respectively, the source electrodes of the switches are connected substantially directly together at a common node 26. The switches may comprise other devices having complementary conduction modes, such as pnp and npn Bipolar Junction Transistors. A resonant load circuit 28 includes a resonant inductor 30 and a resonant capacitor 32 for setting the frequency of resonant operation. Typically, circuit 28 includes a d.c. blocking capacitor 34 and a so-called snubber capacitor 36.

Switches 22 and 24 cooperate to provide a.c. current from common node 26 to resonant inductor 30. The gate, or control, electrode 38 and 40 of the switches are substantially directly interconnected at a control node or conductor 42. Gate drive circuitry, generally designated 44, is connected between control node 42 and common node 26, for implementing regenerative control of switches 22 and 24. Drive inductor 46 is mutually coupled to resonant inductor 30, to induce in inductor 46 a voltage proportional to the instantaneous rate of change of current in load circuit 28. A second inductor 48 is serially connected to inductor 46, between common node 26 and control node 42. In some applications, it may be desirable to use a further inductor (not shown) connected between the left-shown node of inductor 48 and common node 26. A bidirectional voltage clamp 50 connected between nodes 26 and 42, such as the back-to-back Zener diodes shown, cooperates with second inductor 48 in such manner that the phase angle between the fundamental frequency component of voltage across resonant load circuit 28 (e.g., from node 26 to node 20) and the a.c. current in resonant inductor 30 approaches zero during lamp ignition. A capacitor 52 may be connected in the serial circuit of inductors 48 and 46, between node 26 and node 42, for purposes explained below.

A capacitor 54 is preferably provided between nodes 26 and 42 to predicably limit the rate of change of control voltage between such nodes. This beneficially assures, for instance, a dead time interval during switching of switches 22 and 24 wherein both switches are off between the times of either switch being turned on.

Serially connected resistors 56 and 58 cooperate with a resistor 60 for starting regenerative operation of gate drive circuit 44. In the starting process, capacitor 52 is initially charged, upon energizing of source 16, via resistors 56, 58 and 60. At this instant, the voltage across capacitor 52 is zero, and, during the starting process, serial-connected inductors 46 and 48 act essentially as a short circuit, due to the relatively long time constant for charging of capacitor 52. With resistors 56–60 being of equal value, for instance, the voltage on common node 26, upon initial bus energizing, is approximately one-third of bus voltage 16. In this manner, capacitor 52 becomes increasingly charged, from left to right, until it reaches the threshold voltage of the gate-to-source voltage of upper switch 22 (e.g., 2–3 volts). At this point, the upper switch switches into its conduction mode, which then results in current being supplied by that switch to resonant load circuit 28. In turn, the resulting current in the resonant load circuit causes regenerative control of switches 22 and 24.

During steady state operation of ballast circuit 10, the voltage of common node 26 becomes approximately one-half of bus voltage 16. The voltage at node 42 also becomes approximately one-half bus voltage 16, so that capacitor 52 cannot again, during steady state operation, become charged so as to again create a starting pulse for turning on switch 22. During steady state operation, the capacitive reactance of capacitor 52 is much larger than the inductive reactance of gate driving inductor 46 and second inductor 48, so that capacitor 52 does not interfere with operation of those inductors.

Resistor 60 may be alternatively placed in shunt across switch 22 (not shown) rather than across switch 24. The operation of the circuit is similar to that described above with respect to resistor 60 shunting switch 24. However, initially, common node 26 assumes a higher potential than node 42, so that capacitor 52 becomes charged from right to left. The results in an increasingly negative voltage between node 42 and node 26, which is effective for turning on switch 24.

Resistors 56 and 58 are both preferably used in the circuit of FIG. 1; however, the circuit functions substantially as intended with resistor 58 removed and using resistor 60. Starting might be somewhat slower and at a higher line voltage. The circuit also functions substantially as intended with resistor 56 removed and using an alternative resistor (not shown) to resistor 60 shunting switch 22.

In one embodiment of the invention, shutdown circuit 12 is incorporated into ballast circuit 10 by connection of terminals 62 and 64 of ballast circuit 10 to terminals 66 and 68 of shutdown circuit 12. Shutdown circuit 12 includes a full-wave rectification bridge formed by diodes 70–76, a charging capacitor 78, Zener diode 80, resistor 82 and latch 84 configured of a pnp-npn transistor pair 86,88.

Shutdown circuit 12 is designed to activate when a voltage, higher than a predetermined value, exists for a certain time period. Such situations may occur, for example, when a lamp is removed from the circuit or when end-of-life effects cause a lamp to overheat, especially at lamp electrodes. Shutdown circuit 12 senses voltage across inductor 48, which is rectified by rectifier bridge 70–76, and then used to charge capacitor 78. When the voltage on capacitor 78 exceeds the value of Zener diode 80, current flows in the Zener diode 80 and resistor 82 path, causing activation of latch 84. Activation of latch 84 causes the voltage across inductor 48 to drop, which in turn increases the frequency of ballast circuit 10 beyond the resonant frequency of resonant circuit 28. The increase in circuit frequency, in turn, causes current supplied to lamp 14 to decrease.

Latch 84 is designed through connection of complimentary transistors 86 and 88. The collector 90 of transistor 86 drives the base 92 of transistor 88, and the collector 94 of transistor 88 drives the base 96 of transistor 86. Therefore, there is a direct coupling feedback between the transistors. The feedback is positive since a change in current at any point in the loop is amplified and returned to the starting point with the same phase. Latch 84 has one of two states, open or closed. When latch 84 is placed in an open state, it stays open until an input current forces it to close. If it is in a closed position, it is maintained in that position until an input current or a drop in system voltage forces it to open. Latch 84 is connected to the remainder of shutdown circuit 12 through emitter 98 of transistor 86 and emitter 100 of transistor 88.

One way to close latch 84 is by providing a trigger pulse, to base 92 of transistor 88. This trigger pulse momentarily forward biases base 92. Since there is a large positive feedback, the returning amplified current is much larger than the original input current. At this point, collector 94 of transistor 86 supplies base current to transistor 88, and the trigger pulse is no longer needed. This action is regenerative feedback because once started, the action sustains itself.

The regenerative feedback quickly drives both transistors into saturation, at which point loop gain drops to unity.

One way to open latch 84 is by applying a negative trigger (not shown) to base 92 of transistor 88, which pulls transistor 88 out of saturation. Once this occurs, regeneration takes over and quickly drives the transistors to cutoff points. Another way to open latch 84 is by a low current dropout. This occurs by reducing the input voltage or supply voltage from supply 16 sufficiently so transistors 86,88 come out of saturation and regeneration drives them to a cutoff state.

There will be some delay between the occurrence of a high-voltage state and activation of latch 84. Particularly, the time needed to charge capacitor 78 provides a time delay from the occurrence of a high voltage, until latch 84 is activated. Additionally, the value of Zener diode 80 determines the high voltage value at which shutdown circuit 12 will allow triggering of latch 84.

A concern with implementing shutdown circuit 12, is the possibility of generating false triggering of the shutdown circuit. For example, the start pulse for a gas-discharge lamp, will use a voltage spike to initiate lamp operation. It is possible that this voltage spike will be of a significant enough value as to falsely trigger the shutdown circuit 12. One manner of avoiding these false triggering, would be to size the components such that only a voltage value greater than the spike of the start pulse would cause shutdown circuit 12 to function. However, this may be undesirable in some situations since by not triggering until a value greater than the voltage spike may result in damage of the circuit.

Therefore, it will be desirable in certain situations, to incorporate a time delay into the shutdown circuit such that the maximum voltage which will cause triggering is set below the voltage spike level, but will also avoid false triggering, in the presence of the voltage spike. Such a circuit is discussed in a next embodiment of the present invention.

Figure 2:
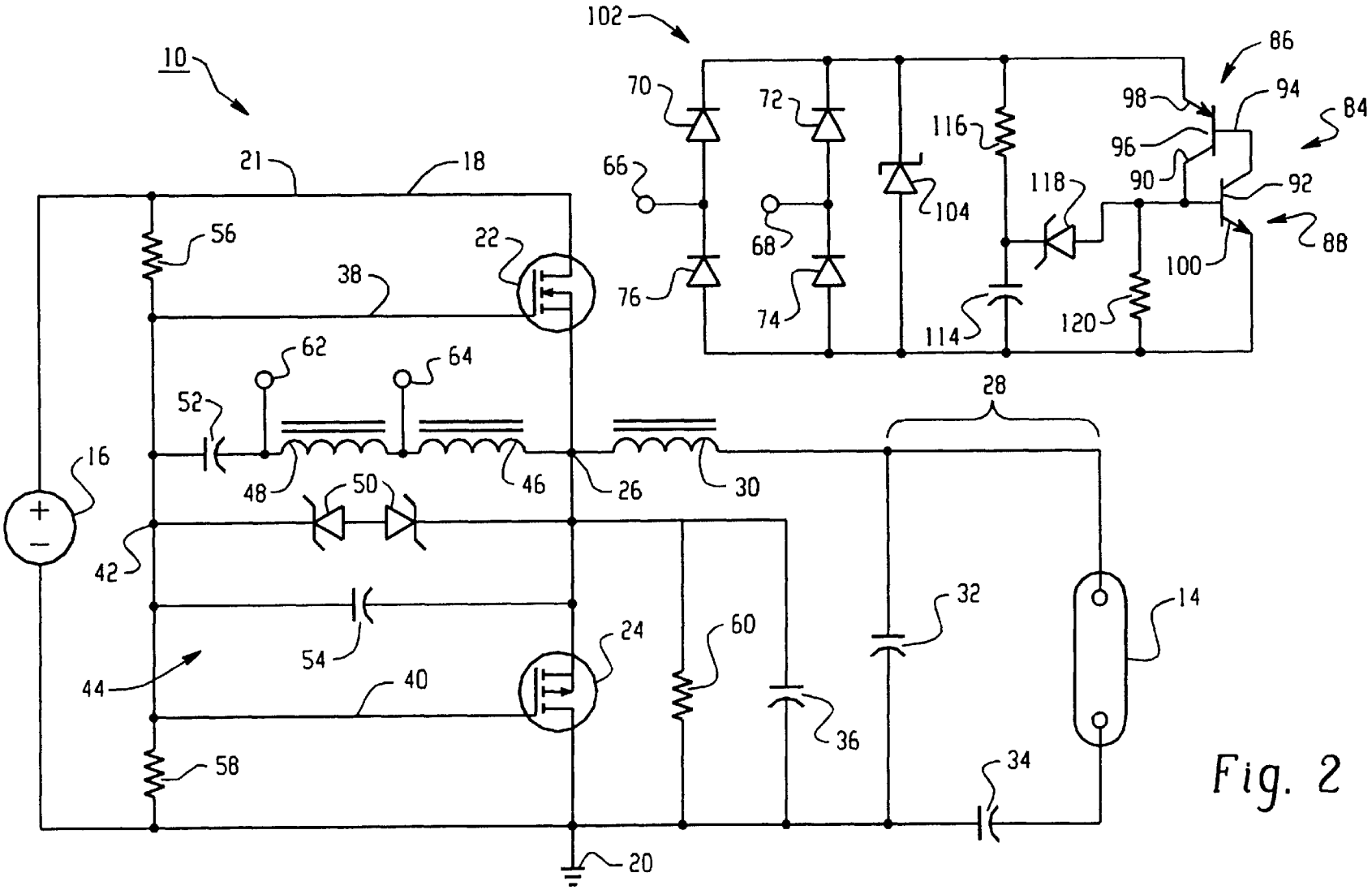
FIG. 2 is a ballast circuit incorporating a further embodiment of a shutdown circuit according to the present invention.

Turning attention to FIG. 2, a second embodiment of the present invention is illustrated. Other than for shutdown circuit 102, ballast circuit 10 operates in the same manner as described in FIG. 1, therefore a detailed discussion regarding its operation will not be undertaken. In shutdown circuit 102, elements which are the same as those shown in shutdown circuit 12 of FIG. 1, are commonly numbered. Shutdown circuit 102 includes a configuration which ensures a clamping or clipping of the voltage within the shutdown circuit 102, and provides for an adjustable time delay for triggering of latch 84, where the time delay is adjustable in accordance with component values.

Similar to the previously discussed shutdown circuit 12, voltage from inductor 48 is monitored and rectified by diode bridge 70–76. In the present embodiment a clipping Zener diode 104 is used to ensure the voltage in shutdown circuit 102 does not exceed a predetermined value, this value being set in accordance with the selected value of clipping Zener diode 104.

Figure 3:
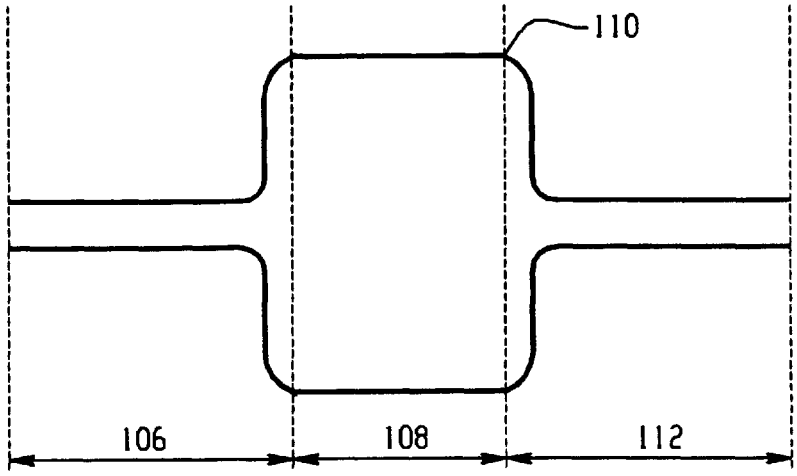
FIG. 3 depicts a wave form of the shutdown circuit of FIG. 2.

Turning attention to FIG. 3, the voltage across inductor 48 during operation of ballast 10, with shutdown circuit 102 incorporated is depicted. FIG. 3 illustrates a situation where a voltage greater than a predetermined value exists for a greater than predetermined time, such that operation of shutdown circuit 102 occurs. A first time period 106 may be considered the ballast circuit preheat phase. During a second time period 108, the voltage across inductor 48 increases to a maximum voltage 110 at which point Zener diode 104 performs clipping action to restrict a further rise in voltage. The clipping portion of shutdown circuit 102 restricts the resonant tank from generating a voltage greater than the maximum selected voltage because the inductor is again being loaded by Zener diode 104.

At the start of a third time period 112, latch 84 is activated thereby decreasing the voltage across inductor 48, raising the frequency output and taking ballast circuit 10 out of resonance. During the second time period 108, but prior to the third time period 112, capacitor 114 is being charged through resistor 116. At the third time period 112, the voltage on capacitor 114 is greater than the value of time delay Zener diode 118, allowing latch 84 to be turned on. Resistor 120 carries leakage current ICBO to prevent false triggers of latch 84. When latch 84 triggers or fires, it can be seen that the voltage across inductor 48 decreases. Dependent upon the values selected for the components, a time delay existing by use of time delay Zener diode 118 is adjustable. Particularly, by increasing time delay Zener diode value 118, a longer time delay prior to activating latch 84 is obtained.

Figure 4:
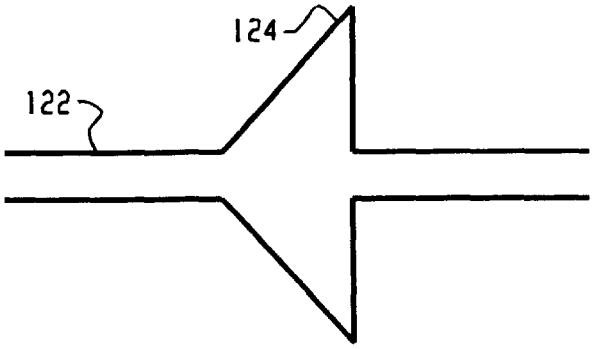
FIG. 4 shows a lamp starting pulse.

A time delay is desirable since, as shown in FIG. 4, during normal operation ballast 10, a lamp start voltage signal 122, is used to activate lamp 14. Particularly, lamp starting voltage signal 122 generates a voltage spike 124 in order to ignite lamp 14. Therefore, if no time delay exists in shutdown circuit 12, normal start signals could falsely trigger latch 84, if the voltage spike is above the predetermined desired voltage level.

It is therefore, desirable to include a time delay in order to avoid false triggering. Shutdown circuit, 102 addresses situations where a high voltage has built up, and has been maintained at a high level for a time greater than desired for a starting pulse.

Figure 5:
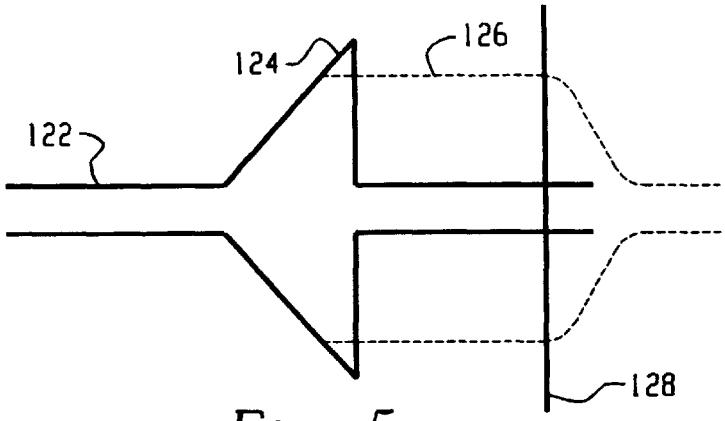
FIG. 5 illustrates a time delay between the lamp starting pulse and the delay trigger point of the shutdown circuit of FIG. 2.

FIG. 5 illustrates the concept of the discussed time delay. Shown in solid line is the lamp start voltage signal 122 operating under normal conditions. Under these normal conditions, voltage spike 124 is generated of sufficient levels to turn on lamp 14, then the spike dissipates. During normal operation, shutdown circuit 102 is not initiated. However, as can be seen by the dotted line, if the voltage level 126 is sufficient to initiate clipping by Zener diode 104, and stays at that level until reaching trigger point 128, shutdown circuit 102 is activated and voltage across inductor 48 is decreased, thereby bringing the circuit out of resonance.

Again, the length of the time delay is built into the shutdown circuit dependent upon the value of the components selected. It is noted that in a preferred embodiment the breakdown voltage on time delay Zener diode 118 is less than the breakdown voltage on clamping Zener diode 104, since there needs to be sufficient voltage on capacitor 114 in order to trigger time delay Zener diode 118. Further, Zener clamping diode 104 is set at a value no higher than the peak starting pulse voltage and no lower than the steady state voltage of ballast 10. For example, if the steady state operational voltage is 13.5 volts, then the clipping voltage level would be greater than that voltage, for example, approximately 15 volts. When clipping Zener diode 104 is conducting (i.e. the system has greater than 15 volts), capacitor 114 is charged to a level which will trigger Zener diode 118.

Exemplary component values for the circuit of FIGS. 1–2 are as follows for fluorescent lamp 14 rated 17.5 watts, with a d.c. bus voltage of 160 volts:

| | |
|---|---|
| Resonant inductor 30 | 600 micro henries |
| Driving inductor 46 | 2.0 micro henries |
| Turns ratio between 30 and 46 | 17:1 |
| Second inductor 48 | 250 micro henries |
| Capacitor 54 | 4.7 nanofarads |
| Capacitor 52 | 0.1 microfarads |
| Zener diodes 50, each | 10 volts |
| Resistors 56, 58 and 60, each | 270 k ohms |
| Resonant capacitor 32 | 3.3 nanofarads |
| D.c. blocking capacitor 34 | 0.22 microfarads |
| Snubber capacitor 36 | 470 picofarads |
| Diodes 70–76 (FIGS. 1–2) | 1N4148 |
| Capacitor 78 (FIG. 1) | 1.0 microfarads |
| Zener diode 80 (FIG. 1) | 15 volts |
| Resistor 82 (FIG. 1) | 10 k ohms |
| Zener diode 104 (FIG. 2) | 24 volts |
| Resistor 116 (FIG. 2) | 100 k ohms |
| Capacitor 114 (FIG. 2) | 1 microfarad |
| Zener diode 118 (FIG. 2) | 15 volts |
| Resistor 120 | 10 k ohms |

Additionally, switch 24 may be an IRFR210 or IRFR214, n-channel, enhancement mode MOSFET, sold by International Rectifier Company, of El Segundo, Calif.; and switch 22, an IRFR9210 or IRFR9214, p-channel, enhancement mode MOSFET also sold by International Rectifier Company. Latch 84 may be a npn-pnp transistor pair (pnp-2N3906; npn-2N3904).

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. In a ballast circuit for a gas discharge lamp, a shutdown circuit for limiting voltage output of a d.c.-to-a.c. converter, said shutdown circuit comprising:

(a) a terminal arrangement connected to the d.c.-to-a.c. converter to sense an inductor voltage of the d.c.-to-a.c. converter;

(b) a rectifier network configured to receive the inductor voltage from the terminal arrangement and generate a rectified voltage; and (c) a latch arranged to receive the rectified voltage and to enter an active state when the rectified voltage is above a predetermined value, wherein when the latch is activated the inductor voltage is decreased.

2. The invention according to claim 1 wherein the rectifier network is a full bridge rectifier.

3. The invention according to claim 1 wherein the shutdown circuit includes a clipping device connected to limit an upper level voltage of the shutdown circuit.

4. The invention according to claim 1 wherein the clipping device is a clipping Zener diode.

5. The invention according to claim 1, wherein, a time delay circuit is located between the rectifier network and the latch, whereby a delay time is provided between rectifying of a voltage sufficient to activate the latch and actual activation.

6. The invention according to claim 2 wherein the time delay circuit is a capacitor.

7. The invention according to claim 2 wherein the time delay circuit includes a charging capacitor connected to a time delay Zener diode.

8. The invention according to claim 7 wherein a value of a clipping Zener diode is greater than a value of the time delay Zener diode.

9. The invention according to claim 8 wherein the clipping Zener diode voltage value is less than the peak voltage start pulse of the a.c.-to-d.c. converter circuit.

10. The invention according to claim 1 wherein the ballast circuit further includes:

(i) a resonant load circuit incorporating the gas discharge lamp and including a resonant inductor and a resonant capacitor;

(ii) the d.c.-to-a.c. converter circuit is coupled to said resonant load circuit for inducing an a.c. current in said resonant load circuit, said converter circuit comprising:

(a) first and second switches serially connected between a bus conductor at a d.c. voltage and a reference conductor, being connected together at a common node through which said a.c. load current flows, and being connected through respective gate electrodes to control node;

(iii) a gate drive arrangement for regeneratively controlling said first and second switches; said gate drive arrangement comprising:

(a) a driving inductor mutually coupled to said resonant inductor in such manner that a voltage is induced therein which is proportional to the instantaneous rate of change of said a.c. load current; said driving inductor being connected between said common node and said control node;

(b) a second inductor serially connected to said driving inductor, with the serially connected driving and second inductors being connected between said common node and said control nodes and said second inductor further connected between the terminals; and (c) a bi-directional voltage clamp connected between said common node and said control nodes for limiting positive and negative excursions of voltage of said control nodes with respect to said common node.

11. A ballast circuit for a gas discharge lamp, comprising:

(a) a resonant load circuit incorporating the gas discharge lamp and including a resonant inductance and a resonant capacitance;

(b) a d.c.-to-a.c. converter coupled to said resonant load circuit for inducing an a.c. current in said resonant load circuit, said d.c.-to-a.c. converter including an inductor across which is a voltage of the d.c.-to-a.c. converter;

(c) a drive arrangement for controlling operation of said d.c.-to-a.c. converter;

(d) a shutdown circuit for limiting voltage output of the d.c.-to-a.c. converter, said shutdown circuit comprising:

(i) a terminal arrangement connected to the d.c.-to-a.c. converter to sense the inductor voltage of the d.c.-to-a.c. converter;

(ii) a rectifier network configured to receive the inductor voltage from the terminal arrangement and to generate a rectified voltage;

(iii) a latch arranged to receive the rectified voltage and to enter an active state when the rectified voltage is above a predetermined value, wherein when the latch is activated, the inductor voltage is decreased; and (iv) a time delay circuit located between the rectifier network and the latch, whereby a delay time is provided between rectifying of a voltage sufficient to activate the latch and actual activation.

12. The invention according to claim 11 wherein the rectifier network is a full bridge rectifier.

13. The invention according to claim 11 wherein the time delay circuit is a capacitor.

14. The invention according to claim 11 wherein the latch is a pair of transistors.

15. The invention according to claim 14 wherein the pair of transistors are one each of an n-p-n and p-n-p transistors.

16. The invention according to claim 11 wherein the shutdown circuit includes a clipping device connected to limit an upper level voltage of the shutdown circuit.

17. The invention according to claim 16 wherein the clipping device is a clipping Zener diode.

18. The invention according to claim 11 wherein the time delay circuit includes a charging capacitor connected to a time delay Zener diode.

19. The invention according to claim 18 wherein the clipping Zener diode voltage value is greater than the voltage value of the time delay Zener diode.

20. The invention according to claim 19 wherein the clipping Zener diode voltage value is less than the peak voltage start pulse of the a.c.-to-d.c. converter circuit.

* * * * *